United States Patent [19]

Kaufman

[11] 4,108,222

[45] Aug. 22, 1978

[54] COLLAPSIBLE DISPOSABLE FUNNEL

[75] Inventor: George Kaufman, North Brunswick, N.J.

[73] Assignee: Union Carbide Corporation, New York, N.Y.

[21] Appl. No.: 754,530

[22] Filed: Dec. 27, 1976

[51] Int. Cl.[2] ..... B65B 39/00; B67C 11/02

[52] U.S. Cl. ..... 141/337

[58] Field of Search ..... 141/199-205, 141/297-300, 331-345; 222/526, 527

[56] References Cited

U.S. PATENT DOCUMENTS

| | | | |
|---|---|---|---|
| 952,313 | 3/1910 | Droz | 141/334 X |
| 3,572,318 | 3/1971 | Garland | 141/337 X |

*Primary Examiner*—Richard E. Aegerter
*Assistant Examiner*—Frederick R. Schmidt
*Attorney, Agent, or Firm*—Clement J. Vicari

[57] ABSTRACT

A collapsible funnel having a body portion and a movable dam forming an integral part of the body portion located adjacent a fluid inlet for the funnel. The dam in operating condition is in the form of a movable wedge-like configuration.

5 Claims, 4 Drawing Figures

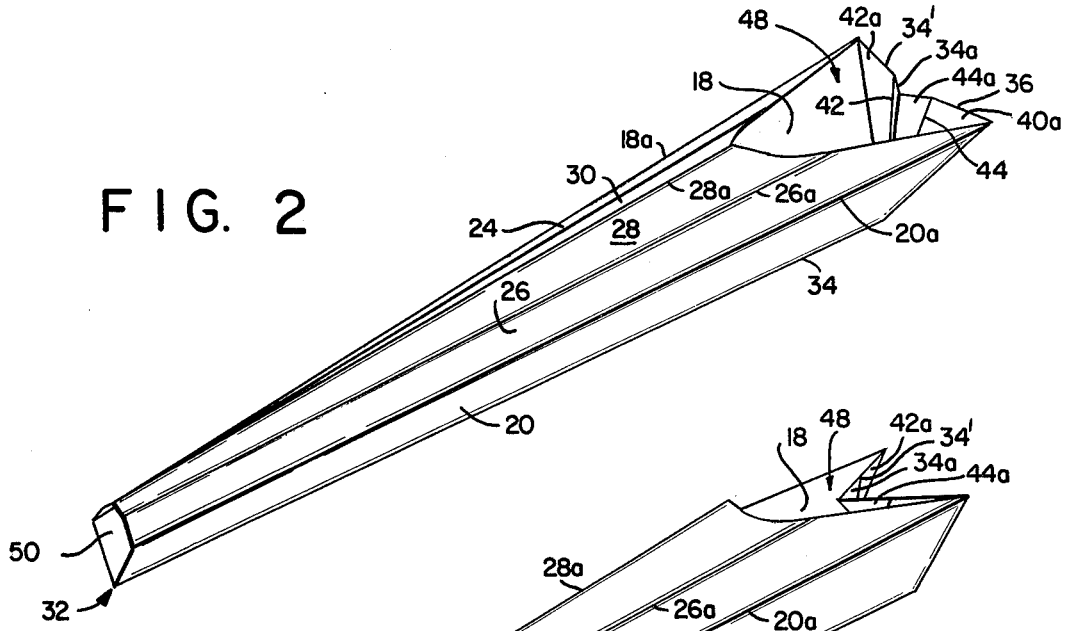
FIG. 2
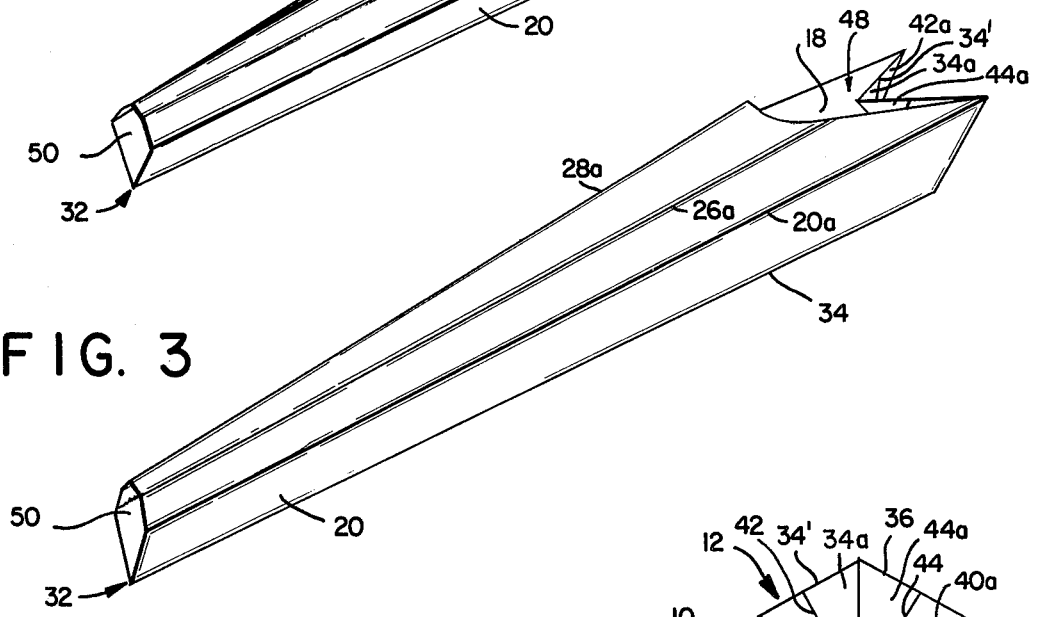
FIG. 3
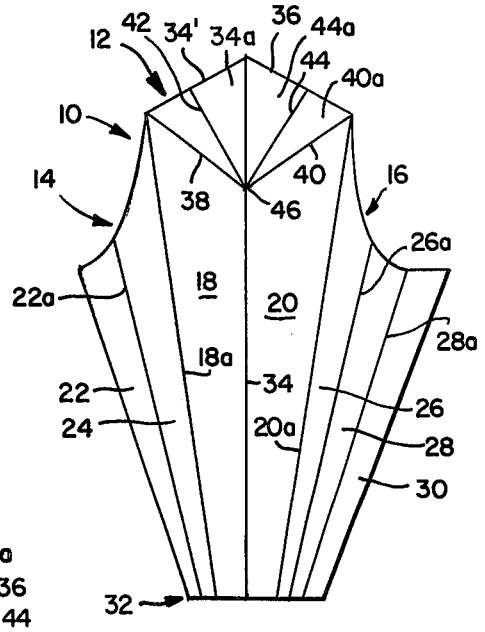
FIG. 1
FIG. 4
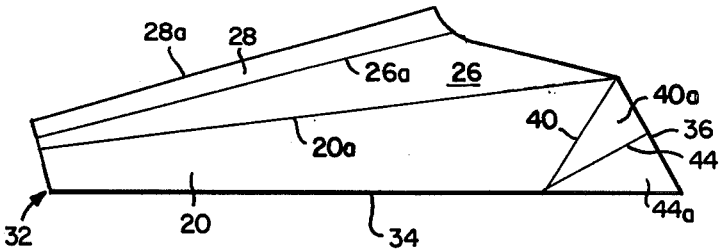

COLLAPSIBLE DISPOSABLE FUNNEL

The present invention relates to funnels and more particularly to disposable gas tank additive funnels.

Many currently manufactured automobiles are being provided with catalytic converters and restrictors in the gas filler pipe. The restrictor in the gas filler pipe is also equipped with a spring loaded hinged door which must be opened manually. In some car models, the gas filler pipe is almost horizontal and buried in the bumper or fender. The geometry is such that a conventional funnel is inadequate to reach in far enough or must be positioned too horizontally to function unless a flexible hose is attached.

Consequently there is currently a need for an inexpensive collapsible disposable funnel which is long enough and narrow enough to open the hinged door and clear the external hardware and since the filling of the tank in some cases requires almost horizontal positioning of the funnel, the funnel should be equipped with provision for preventing spillage from the rear of the funnel.

Accordingly it is an object of the invention to provide a disposable, collapsible funnel which can be inserted into a gas tank opening and which can be operated in substantially horizontal position without spillage from the rear of the funnel.

Another object of the invention is to provide a disposable, collapsible funnel which is equipped with a collapsible rear dam and which is relatively inexpensive to manufacture.

These and other objects will become apparent from the following description taken in conjunction with the accompanying drawing in which:

FIG. 1 is a face view of a blank form from which a funnel in accordance with the invention can be fabricated.

FIG. 2 is a perspective view of the funnel with the dam in an operating position.

FIG. 3 is a view similar to FIG. 2 but showing the sides urged towards each other and the dam advanced towards the fluid outlet.

FIG. 4 is a side view of a collapsed funnel in accordance with the present invention.

Broadly contemplated, the present invention provides a collapsible funnel comprising a body portion and a dam forming an integral part of the body portion, the body portion having a cross section defined perimetrically by two bottom panels separated by a fold line extending longitudinally along the panels and being folded along the fold line into a V-shaped disposition at the lower portion of the cross section. The bottom panels subtend and connect with multiple panel walls arranged in polygonal disposition at the upper portion of the cross section to provide a fluid inlet, a fluid outlet and a fluid passageway for the funnel. The dam is formed into a movable vertically disposed wedge like configuration by a series of fold lines having a common vertex along the bottom panel fold line.

The arc-shaped edges of the multiple panel walls provide the U-shaped fluid inlet for the funnel proximate the rear of the funnel, and the funnel tapers inwardly from the fluid inlet to the fluid outlet disposed at the opposite end of the funnel. In a preferred embodiment the multiple panel walls are of a generally semi-octagonal configuration. In collapsed condition the bottom panels are disposed adjacent each other and the collapsed upper panel walls are in general alignment with the bottom panels. The dam portion is folded along the bottom panel fold line so that the dam is divided into two equal segments each of which are disposed in adjacent relation in planar alignment with the corresponding bottom panel.

Referring to the drawing, FIG. 1 is a face view of a typical blank from which a funnel in accordance with the present invention can be fabricated. The blank can be of a material which is substantially rigid such as paper, folding board, monolithic or laminated plastic film or sheet, plastic coated paper or folding board. The blank contains a body portion 10 and a dam 12. The body portion has unsymetrical wing portions 14 and 16 situated adjacent bottom panels 18 and 20 respectively. Wing portion 14 has top panels 22 and 24 separated by fold line **22*a* which extends longitudinally along the body portion, and converges towards the base 32 of the body portion 10. Wing portion 16 is also provided with panels 26, 28 and 30 separated by fold lines 26*a* and 28*a* each of which extend longitudinally along the body portion 10 and converge towards base 32**.

The bottom panels 18 and 20 are separated by fold line 34 which extends the longitudinal length of the body portion. As will be seen from FIG. 1, the panels 18 and 20 gradually taper inwardly as they approach base 32. Fold lines **18*a* and 20*a* separate the bottom panels 18 and 20 from side panels 24 and 26 respectively. The upper edges 34' and 36 of bottom panels 18 and 20 are slanted with respect to fold line 34 and define the upper edge of dam 12**.

Dam 12 is formed by a series of fold lines having a common vertex 46 on fold line 34. Thus at a location approximately ¼ of the distance along the total length of fold line 34 two fold lines 38, 40 extend outwardly and upwardly to meet the upper edges 34' and 36 to impart a substantially diamond shape configuration to dam 12. The dam is divided into quadrants by fold lines 42, 44 and the upper portion of fold line 34 each having an origination point at vertex 46. Thus fold lines 40, 44, 42, 38 and the upper portion of fold line 34 define triangular areas **40*a*, 44*a*, 34*a* and 42*a*** respectively.

The funnel can be constructed by folding panels 22, 24, 18, 20, 26, 28 and 30 inwardly around the longitudinal axis of the funnel along fold lines **22*a*, 18*a*, 34, 20*a*, 26*a* and 28*a* and superimposing and adhering panel 30 to panel 22 to form the funnel shown in FIG. 2**.

Thus with reference to FIG. 2 it will be seen that the funnel has a cross section defined perimetrically by the bottom panels 18 and 20 being in the form of a "V" shaped configuration and are disposed at the lower portion of the cross section subtending and connecting with panels 22, 24, 26 and 28 arranged in substantially a semi-octagonal configuration with fold line **28*a* substantially overlying and being aligned with fold line 34. The upper edges of wing portion 14 and 16 are arc-shaped and when panel 30 is superimposed on panel 22 a generally U-shaped mouth opening 48 of the funnel is formed which is disposed in the upper portion of the funnel adjacent the multiple wall panels and the dam 12. It will be seen from FIG. 2 that the funnel is wider in the rear portion and generally tapers towards the base portion and terminates in discharge outlet 50**.

In order to form the dam portion of the funnel the dam is folded inwardly towards base 32 along fold lines 38 and 40 so as to advance the upper portion of fold line 34 towards the discharge end of the funnel. In similar manner fold lines 42 and 44 are folded inwardly from the vertex 46 resulting in the dam configuration shown in FIG. 2.

It will be seen from FIG. 2 that the upper portion of fold line 34 projects further towards base 32 than fold lines 42, 44 so as to form a wedge with fold line 34 being the leading edge and panels 40*a*, 44*a*, 34*a* and 42*a* extending angularly away from the leading edge towards fold lines 38 and 40.

Because of the geometrical design of the funnel, an important advantage is achieved in the instant invention i.e. that the leading edge of the dam is urged forward and the dam is strengthened when pressure is exerted against the side edges of the funnel, i.e. the edges corresponding to fold lines 18*a* and 20*a* as shown in FIG. 3. Thus for certain sizes of openings since the front part of the funnel is narrower than the rear part, the funnel can be inserted with the sides of the funnel in contact with the sides of the opening of the gas tank so as to help keep the dam 12 urged towards the base of the funnel.

FIG. 4 shows the funnel in a collapsed condition, i.e. the funnel flat with the bottom panels being folded along fold line 34 and panels 20, 26 and 28 in contacting relation with panels 18, 24 and 22 respectively. The dam 12 is also pivoted rearward around vertex and bent along fold lines 38 and 40 so that triangular areas 40*a* and 44*a* are in contacting relation with triangular areas 42*a* and 34*a* respectively.

Although the present invention has been described with preferred embodiments, it is to be understood that modifications and variations may be resorted to, without departing from the spirit and scope of this invention, as those skilled in the art will readily understand. Such variations and modifications are considered to be within the purview and scope of the appended claims.

What is claimed is:

1. A collapsible funnel comprising a body portion and a moveable dam forming an integral part of said body portion, said body portion having a cross section defined perimetrically by two bottom panels separated by a fold line extending longitudinally along said panels and being folded along said fold line into a V-shaped disposition at the lower portion of said cross section, said bottom panels subtending and connecting with multiple panel walls arranged in polygonal disposition at the upper portion of said cross section to provide a fluid inlet on one end of said connected multiple wall panels adjacent said dam, a fluid outlet on the opposite end of said connected panels, said connected panels remote from said dam defining an enclosed fluid passageway for said funnel leading from said fluid inlet to said fluid outlet, said dam being formed into a movable vertically disposed wedge-like configuration by a series of fold lines having a common vertex along said bottom panel fold line, forward and rearward movement of said dam being accomplished by application and release of pressure respectively against the side edges of said funnel.

2. A collapsible funnel according to claim 1 wherein said multiple wall panels are of a semi-octagonal configuration.

3. A collapsible funnel according to claim 2 wherein said series of fold lines on said dam are five fold lines starting from a common vertex along said bottom fold line and extending upwardly and outwardly to form triangular areas on said dam.

4. A collapsible funnel according to claim 3 wherein one of said fold lines is a portion of said bottom fold line and when in operating condition extends furthermost from said remaining fold lines of said dam towards said fluid outlet.

5. A collapsible funnel according to claim 1 wherein when said funnel is in collapsed condition said funnel is flat with said bottom panels being in contacting relation, opposed multiple wall panels being in contacting condition and said dam being extended rearwardly of said body portion and in general planar alignment with said body portion.

* * * * *